United States Patent [19]

Przewalski

[11] Patent Number: 4,542,703

[45] Date of Patent: Sep. 24, 1985

[54] COUNTER CURRENT INCINERATION UNIT

[75] Inventor: Zygmunt J. Przewalski, Granby, Conn.

[73] Assignee: MSP, Inc., Broad Brook, Conn.

[21] Appl. No.: 662,572

[22] Filed: Oct. 19, 1984

[51] Int. Cl.[4] ..... F23G 5/06

[52] U.S. Cl. ..... 110/246; 110/165 R; 110/213; 110/226; 110/259

[58] Field of Search ..... 110/246, 226, 259, 165 R, 110/210, 213

[56] References Cited

U.S. PATENT DOCUMENTS

| | | | |
|---|---|---|---|
| 2,104,040 | 1/1938 | Hurt . | |
| 2,274,780 | 3/1942 | Duerr et al. | 110/246 X |
| 3,357,382 | 12/1967 | Matteini . | |
| 3,561,379 | 2/1971 | Polsak . | |
| 3,705,711 | 12/1972 | Seelandt et al. | 110/246 X |
| 3,847,095 | 11/1974 | Bauer et al. | 110/246 |
| 3,861,335 | 1/1975 | Przewalski | 110/246 X |
| 3,882,801 | 5/1975 | Bolle | 110/246 X |

*Primary Examiner*—Edward G. Favors
*Attorney, Agent, or Firm*—Hayes & Reinsmith

[57] ABSTRACT

An incineration unit is provided with an open ended rotary incineration chamber having a main portion and a neck portion supported between two opposite stationary end chambers. Feed means are mounted adjacent first stationary end chamber and a burner for directing flame into the incineration chamber is mounted on the second stationary end chamber. A secondary combustion chamber extends axially above the incineration chamber and includes an afterburner for completely incinerating the combustion gases and by-products. A conduit is formed in first stationary end chamber for transferring hot incineration gases to the secondary combustion chamber. The burner directs the flow of hot incineration gases towards the raw waste material thereby to initiate drying thereof. A grate cleaning member is also provided at the discharge end of the chamber to assist in the separation of waste material.

7 Claims, 6 Drawing Figures

COUNTER CURRENT INCINERATION UNIT

BACKGROUND OF THE INVENTION

The present invention relates generally to high temperature incineration systems and is more particularly concerned with a new and improved rotary incineration system utilizing the flow of hot gases to dry unincinerated waste material.

Incineration systems have been efficiently utilized heretofore for the disposal of waste materials such as garbage and the like. In recent years, however, new chemicals and materials have been developed which are extremely durable, some of which may also be toxic, and if not properly processed, may present potential health and environmental hazards. Conventional incineration systems are not able to effectively incinerate these materials and other waste materials which contain moisture.

State of the art incineration systems include rotary kilns employing a waste tumbling principle. In these systems, a rotary kiln or cumbustion chamber of generally cylindrical configuration has one end which contains suitable apparatus for both feeding the waste material and igniting the waste material. This design dictates that the hot flue gases generated from the burning waste materials flow in a direction away from the waste material inlet, concurrently with the burning mass, towards the opposite end of the chamber. Such an incineration system configuration is shown in United States Pat. No. 3,861,335 issued to the applicant of this application.

Other previous efforts have been directed to the efficient disposal of waste materials, such as United States Pat. No. 3,357,382 to S. Matteini entitled "Solid Trash Drying and Incinerating Furnace". The U.S. Pat. No. 3,357,382 is illustrative of multiple rotary chamber incineration units which present installation problems do to their size and complexity. The design also does not allow for an incineration unit of this type to be adapted for portable use, such as truck mounting or the like. Moreover, the Matteini patent is typical of the type of incinerator that does not show or even suggest a secondary combustion means for treatment of the incineration by-products to ensure complete incineration of waste products.

Moreover, the durable nature of the man-made materials requires special and creative equipment design to effectively incinerate and dispose of these wastes. It has been recognized that high temperature incineration is an effective method to eliminate the potential hazards associated with the durable materials.

Accordingly, it is the principle object of the present invention to provide a new and improved incineration system having a construction that efficiently directs the flow of hot incineration gases in a direction opposite to the flow of the waste materials within a single rotary incineration chamber to effectively dry the waste material to be incinerated and enable appropriate treatment of incineration by-products to ensure complete combustion thereof.

Another object of the invention is to provide an incineration unit which includes means for automatic ash discharge and separation of larger, non combustible materials allowing for the recovery of such non combustible materials.

Still another object of the invention is to provide an incineration unit which is suitable for economically incinerating both wet and dry waste materials at very high temperatures so as to completely breakdown the materials.

It is still another object of this invention to provide an incineration system which can be constructed from standard building materials without requiring expensive materials or complicated mechanical design solutions while assuring operational longevity.

A further object of the invention is to provide for an improved high temperature incineration system which due to its compact design, can be adapted into a mobile system.

Other objects will be in part obvious and in part pointed out in more detail hereinafter.

SUMMARY OF THE INVENTION

These and related objects are achieved by providing an incinerator unit having an open ended rotary incineration chamber supported between two stationary end chambers. A first end chamber communicates with a feed device for supplying waste material to the rotary incineration chamber and forms a conduit which interconnects the rotary incineration chamber and a secondary combustion chamber for transferring combustion gases therebetween. A second end chamber mounts a suitable fuel fired ignition burner for directing flame into the rotary incineration chamber and furthermore directs the flow of hot incineration gases toward the first end of incineration chamber, in a flow counter to the waste material movement, to effect preheating and drying of the waste material before incineration. The secondary combustion chamber includes an afterburner which ensures complete high temperature combustion of incineration gases and by-products.

Means are also provided at the second end chamber for removing, discharging and separating the incinerated and nonincinerated material therefrom.

A better understanding of the objects, advantages, features, properties and relations of the invention will be obtained from the following detailed description and accompanying drawings which set forth certain illustrative embodiments and are indicative of the various ways in which the principles of the invention are employed.

A BRIEF DESCRIPTION OF THE DRAWINGS

DESCRIPTION OF A PREFERRED EMBODIMENT

Figure 1:
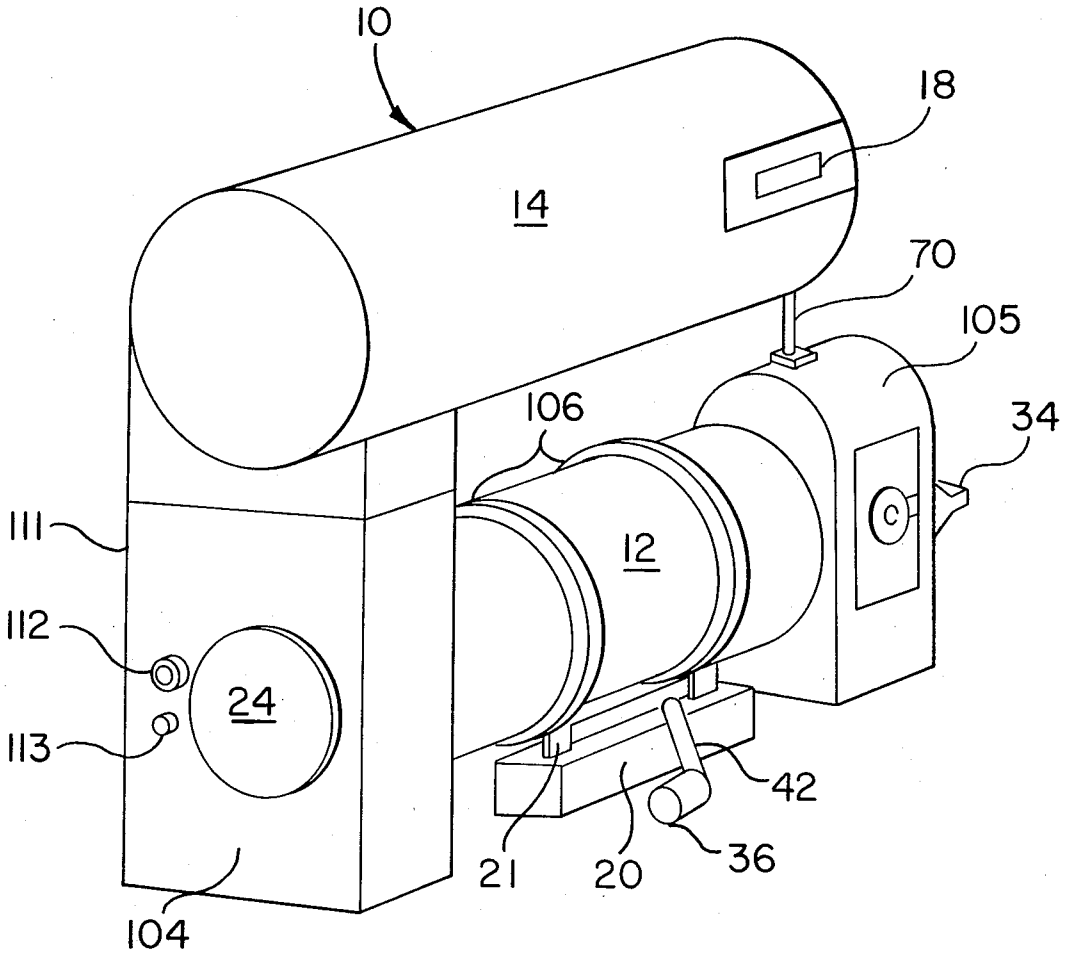
FIG. 1 is a perspective view of a self-contained incinerator unit embodying the features of the present invention.

Referring now to the drawings in greater detail wherein like reference numerals indicate like parts throughout the several figures, it will be noted that the preferred configuration of the self-contained incinerator unit 10 of the present invention consists essentially of an incineration chamber 12, shown as having a main portion 100 of constant diameter and cylindrical cross sectional interior configuration, extending from a neck and inlet portion 101 at first end 11 towards its second end 13; inlet portion 101 of smaller diameter than main portion 100. Two stationary end chambers 104 and 105 are located at opposite ends of rotary incineration chamber 12. First stationary end chamber 104 forms a waste ingress 31 and a gas conduit 16 which interconnects a secondary combustion chamber and primary incineration chamber 12. Second stationary end chamber 105 forms a waste material receptacle, generally indicated by the numeral 90, for containing waste products. Inlet portion 101 of incineration chamber 12 communicates with feed ingress 31 thereby allowing waste material to be feed directly into incineration chamber 12. The incineration chamber 12 is mounted for rotation about an axis with an appropriately configured base structure 20. Second stationary end chamber 105 includes an end wall 28 which closes second end of incineration and mounts the ignition burner 34. The ignition burner 34 extends into the primary chamber 12 and is supported at an angle, approximately 15 degrees from the horizontal. In this manner, the flame projecting from the burner 34 is in a position to initiate the incineration action on the waste material added to the combustion zone.

The secondary chamber 14 is mounted between first end chamber 104 and support beam 70 extending axially above the incineration chamber 12 and along the length thereof. To ensure that complete combustion of all materials, including durable materials such as plastics and toxins occurs, the secondary combustion chamber 14 must be operated at extremely high temperatures, over 2200 degrees fahrenheit, and must provide means for retaining the waste material incineration particles and gases for an appropriate time. To accomplish this goal, an afterburner 19 is preferrably mounted adjacent first end of incineration chamber 12 so as to inject a flame into secondary chamber 14. Afterburner 19 may be a specially designed spinning or vortex flame type which imparts a cyclonic or spiral gas flow within the secondary chamber 14. The spiral or cyclonic gas flow directs the combustion gases through the total volume of secondary combustion chamber thereby retaining the gases within secondary chamber a sufficient time to assume complete combustion thereof. Additionally, the spinning or vortex flame burner provides for complete mixing of the exhaust gases from the primary combustion chamber and eliminates the possibility of blow back therein to ensure trouble free operation of the incinerator. Secondary combustion chamber 14 communicates with an exhaust port 18 for discharge of effluent into a conventional gaseous pollution abatement system (not shown) to ensure proper treatment of incineration by-products.

The incineration chamber 12 is also provided with a pair of axially spaced guidetracks 106 which travel along the supporting and guiding rollers 21 mounted on suitable supports 50 secured to a base 20. The support rollers 21 and tracks 106 are located on opposite ends of chamber 12 and maintain the chamber in an appropriate position for rotation about the longitudinal axis of the cylindrical interior walls thereof. Suitable drive means such as a motor 36 are mounted at the base 20 of incinerator unit and communicate with conventional gears 42 for imparting rotation to incineration chamber 12. In this connection, it should be noted that the exterior surface of chamber 12 may be of any suitable configuration, although the cylindrical configuration illustrated is preferred.

As stated above, incineration chamber 12 may be mounted on a horizontal axis, but in a preferred embodiment, chamber 12 is mounted at a slight downhill angle from first end 11 to second end 13. The angle of inclination may be between a range of 0°–5° to enhance the passage of waste material and the degree of mixing during operation.

At the outside end wall 111 of first end chamber 104 an inlet or feed mechanism 30 for solid waste materials is mounted and communicates with the interior of incineration chamber 12 through opening 24 for feeding solid waste material thereto for incineration. Additionally, ports such as at 112 and 113, are located in end wall 111 for delivery of liquid waste materials or to provide a viewing perspective into interior of incineration chamber 12.

Figure 2:
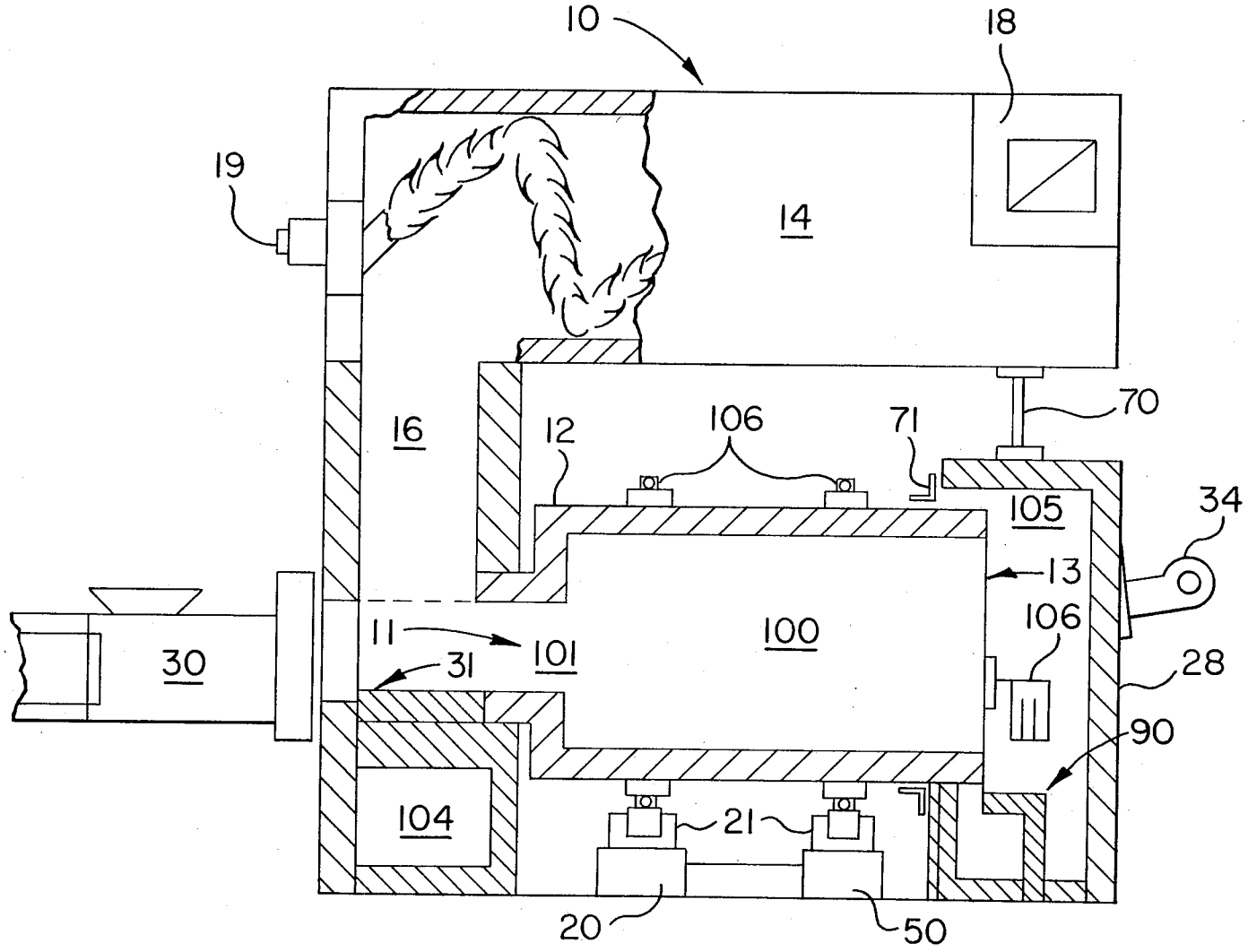
FIG. 2 is an enlarged side elevational view of the incinerator of FIG. 1, partially broken away and partially in section.
Figure 3:
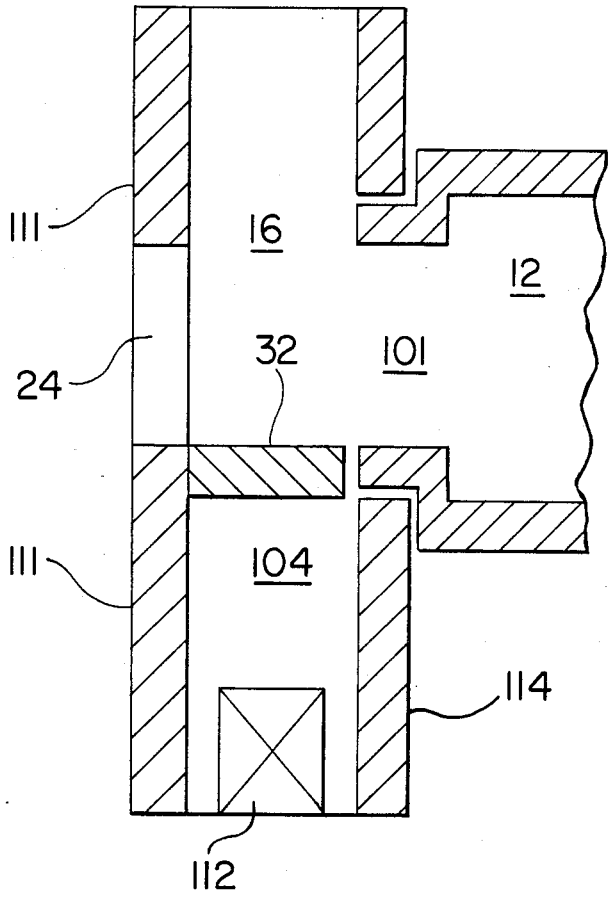
FIG. 3 is a side elevational view, partially broken away, of the feed end of the incinerator unit of FIG. 1.
Figure 4:
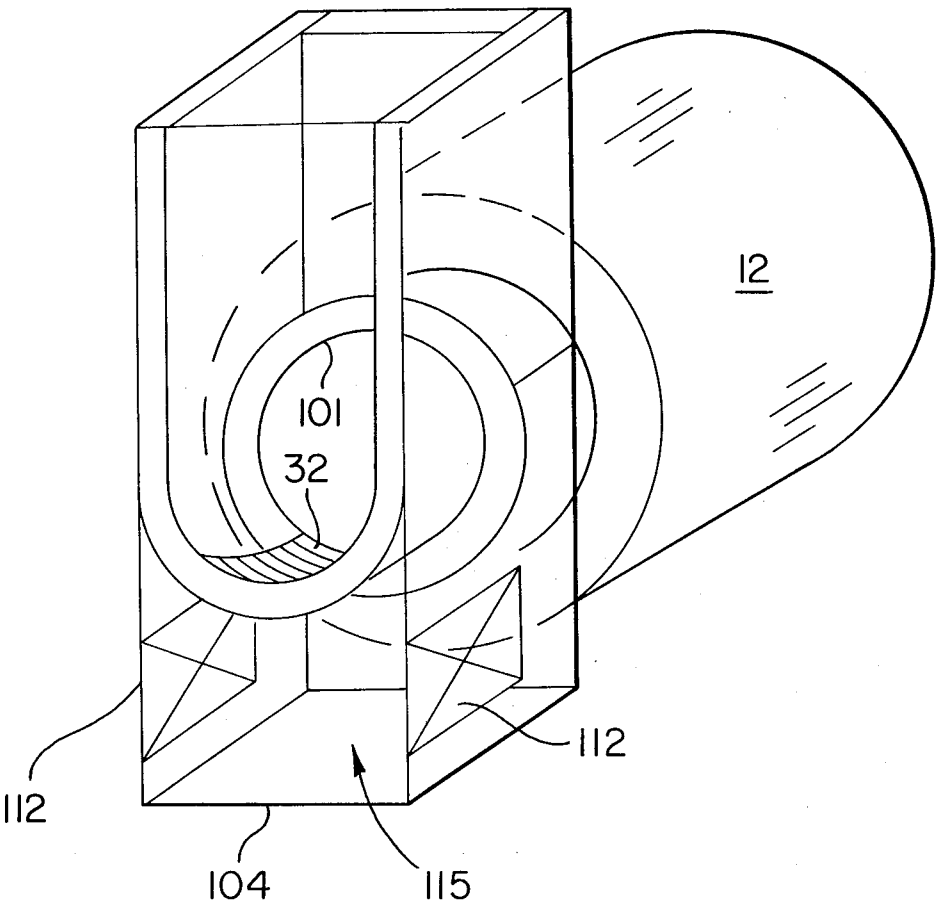
FIG. 4 is a side elevational, three dimensional view of the feed end of the incinerator unit of FIG. 1, partly broken away.

Another important feature of the invention is the arrangement and interconnecting feature of feed mechanism 30 to primary chamber 12. As best seen in FIGS. 2, 3 and 4 a feed surface 32 extends the width of first end chamber 104 and communicates with reduced diameter section 101 of incineration chamber 12 to form a rigid ingress into interior of incineration chamber 12. The incineration gas conduit 16, formed by the feed surface 32 and the surrounding walls of first chamber 104, extends upward from the feed surface 32 and communicates with secondary combustion chamber 14. The interconnection of narrowed diameter section 101 of incineration chamber 12 and first stationary chamber 104 provides a mechanism for minimizing the escape of hot gases and particles as they travel from incineration chamber 12 to secondary combustion chamber 14. FIG. 4 illustrates the first end arrangement of feed surface 32, conduit 16 and chambers 12 and 104 with end wall 111 of first end chamber 104 removed to better illustrate the interrelation of the structural components. A small compartment 115 is formed in the lower section of first end chamber 104 for collection of particles with clean-out openings 112 provided for removal thereof.

The flow of combustion gases in the incineration chamber 12 from discharge or second end 13 towards feed or first end 11 results in the second end being maintained at a lower temperature than that of the first end 11 or combustion zone. Moreover, the position of the feed means 30 opposite the ignition burner 34 allows for the incineration to be more effectively controlled by reducing the quantity of air supply entering the ignition zone. The effect of having the discharge orifice at the low temperature second end of incineration chamber 12, enables removal of incineration waste products through door 58 without substantially effecting the incineration temperature.

Figure 5:
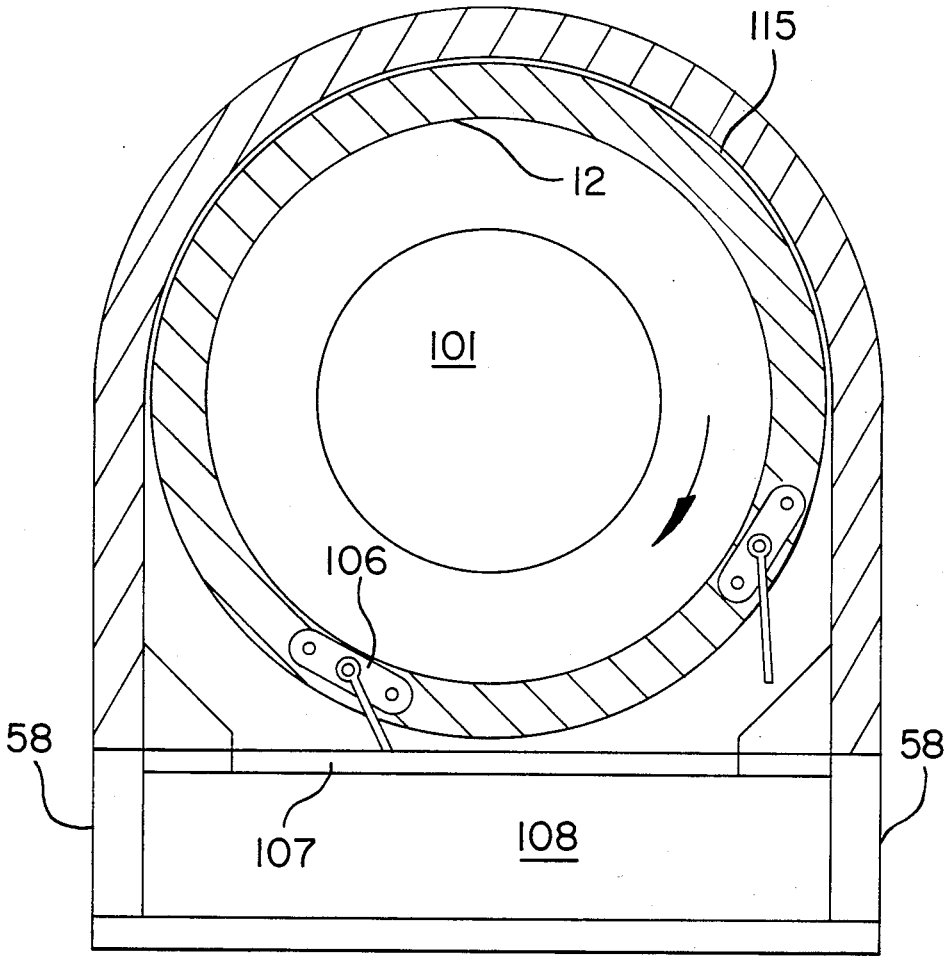
FIG. 5 is a sectional view of a modified embodiment of the combustion system of FIG. 1, illustrating the waste separator arrangement.
Figure 6:
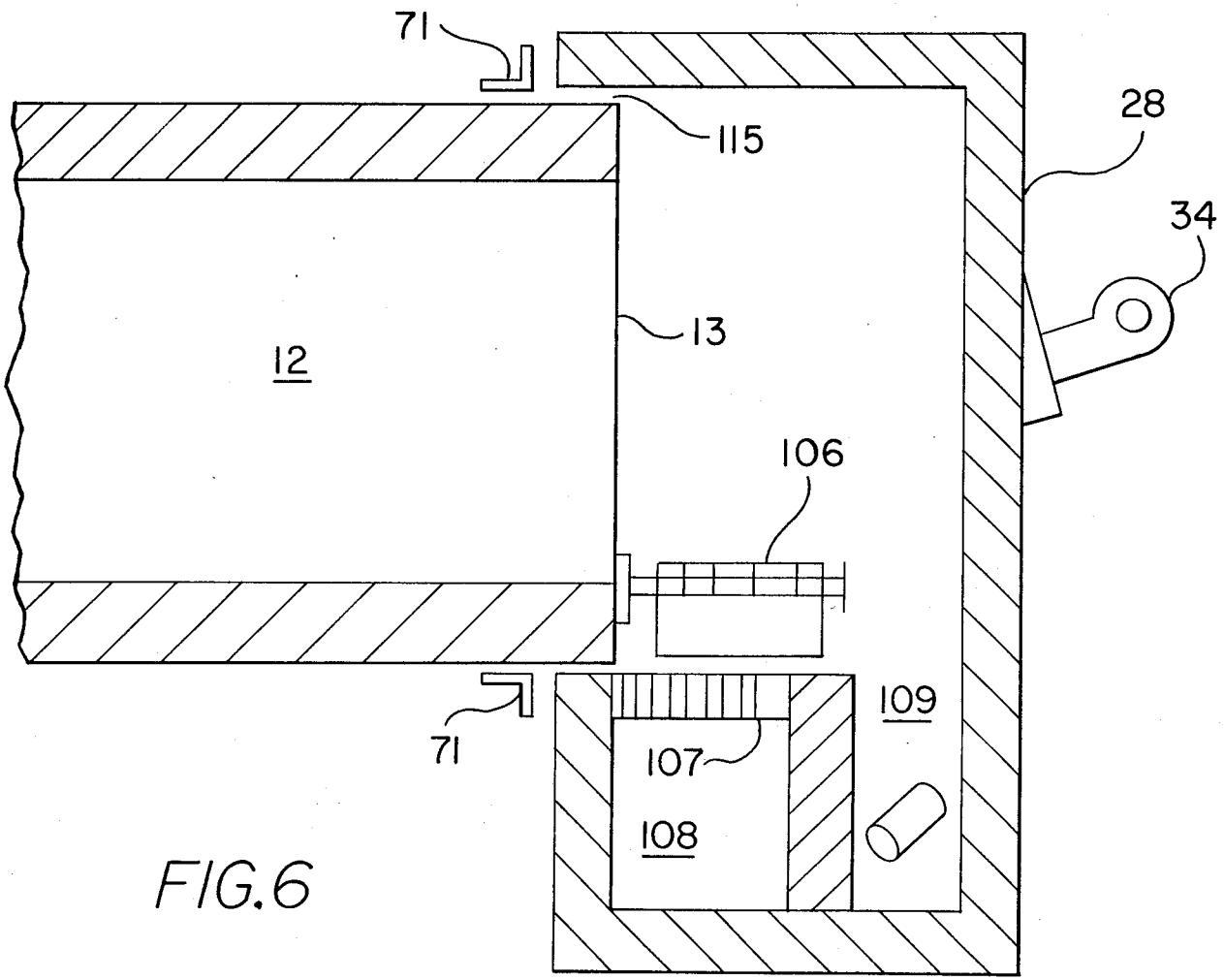
FIG. 6 is an end view of the incinerator unit illustrating a different embodiment of the waste separator arrangement.

As the waste material moves slowly in the direction of ignition burner 34, it is in continuous contact with the hot gases present and is heated and dried, as it enters first end chamber 104 and moves along surface 32 into reduced diameter portion 101. From the reduced diameter portion 101 the material descends slowly toward burner flame and is ignited thereby. As best seen in FIGS. 5 and 6, the incinerator 10 is designed so that second end 13 of incineration chamber 12 is open ended and protrudes into second stationary end chamber 105 defining a discharge opening provided with a fixed grate-like structure, designated generally by numeral 107. Grate structure 107 permits the granulated ash to fall from the second end 11 of incineration chamber 12 into a suitable ash collection bin 108 located therebeneath. However, the ashes also have a tendencey to bridge the grate, and thereby restrict the grate structure 107. Larger pieces of waste material and unincinerated waste material, such as metals or the like, will also remain on grate structure 107. Removal means are provided which enable the removal of these larger and un-incinerated materials. At least one pivotally mounted member 106, having a plurality of fingers or a rake-like extensions, may be operably connected to end portion of chamber 12. As chamber 12 rotates, the rake-like member 106 engages material collected on grate structure 107 breaking larger pieces and sweeping unbreakable and clumped materials off of grate structure 107 and into a second receptacle 109 within lower portion of housing 28 adjacent to bin 108. A door 58 in the end of wall 28 provides access to bins 108 and 109. Any suitable automatic residue removal devices may also be adapted for use with the incineration system.

An adjustable shroud or baffle member 71 is mounted on exterior interconnecting surfaces of incineration chamber 12 and second end chamber 105. Baffle member is preferably formed from two separate interconnecting units which are adjustably mounted to regulate the amount of air which is allowed into incineration chamber 12, thereby to assist in the controlling of the temperature within incineration chamber 12.

Thus as can be seen, the incinerator system of the present invention provides optimum reduction in cost associated with incinerating toxic, durable waste material or with drying any wet or liquid waste material coupled with design simplicity and economy of operation while assuring clean, pollution-free exhaust from the system. As will be appreciated, the system may include suitable automatic or semi-automatic controls or may be controlled manually by a single operator. The operator need simply charge the waste through the charging door or automatic feed mechanism 30 and the rotating incinerating action will proceed automatically without operator participation. Suitable sensors (not shown) may indicate when the incinerator is ready for recharging and or ash collection. As will be appreciated, the walls of the combustion zones are lined with high temperature refractory material suitable for operation within the temperatures to which the incinerator is subjected, such as temperatures up to 3000° F.

Additionally, it should be noted that the incinerator unit of this invention may be mounted on a motor truck chassis so that the incinerator unit may be transported to locations where special incineration problems are encountered. The incinerator unit of this invention is suitable for movement to waste disposal sites thereby eliminating the hazards and expense connected with the handling, transporting and storing of waste materials. While the basic arrangement of operational components is modified to accomodate the truck mounting, the inventive features remove the same.

As will be apparent to persons skilled in the art, various modifications, adaptations and variations of the foregoing specific disclosure can be made without departing from the teachings of this invention.

I claim:

1. In an incinerator unit, an incineration chamber supported between first and second stationary end chambers, said incineration chamber having a main portion and a neck portion, said neck portion communicating with first end chamber to form an inlet opening into said incineration chamber, feed means for delivering waste material into said incineration chamber extending through said first end chamber to a first end of said incineration chamber; said incineration chamber being mounted for rotation for imparting tumbling movement to waste material fed into said incineration chamber, a burner for directing flame into said incineration chamber mounted on said second end chamber and fixed in position at a second end of said incineration chamber; said second end chamber providing a discharge receptacle into which incinerated material will discharge from said second end of said incineration chamber, and a grate means mounted over said discharge receptacle of said second end chamber, and at least one member connected to and extending outward from said incineration chamber for rotation therewith and being engageable with waste materials collected on said grate means to thereby break up and assist in the separation of waste material, whereby said incineration unit enables said waste material fed into said incineration chamber at first end thereof to be dried by flow of gas from said second end as said waste material progresses toward said second end.

2. The incinerator of claim 6 further including a secondary combustion chamber extending axially above said incineration chamber and having an afterburner for directing flame therein, said afterburner mounted adjacent first end chamber.

3. The incinerator of claim 2 further including a conduit extending from said neck portion of said incineration chamber into said secondary chamber for transferring combustion gases thereto.

4. The incinerator of claim 1 wherein said incineration chamber has an axis of rotation which slopes from said first end toward said second end at an angle of 5° or less to promote natural flow of hot incineration gases toward said first end for drying of waste material and to promote movement of waste material toward said second end.

5. The incineration of claim 1 further including a shroud member circumferentially mounted adjacent interconnecting portions of said second end chamber and said incineration chamber coextensively extending around said second end of said incineration chamber to effectively regulate and restict the amount of air into said incineration chamber thereby enabling the control of the temperature within the incineration chamber.

6. The incineration of claim 1 wherein said main section and said neck portion have generally cylindrical cross-sectional interiors, and said neck portion is of smaller diameter than said main section.

7. The incinerator of claim 2 wherein said secondary combustion chamber is cylindrical and said after burner is mounted on end wall of secondary combustion chamber to impart a spiral flow to flame and combustion gases through the total volume of secondary combustion chamber to thereby ensure complete combustion.

* * * * *

UNITED STATES PATENT AND TRADEMARK OFFICE

CERTIFICATE OF CORRECTION

PATENT NO. : 4,542,703

DATED : September 24, 1985

INVENTOR(S) : Zygmunt J. Przewalski

It is certified that error appears in the above—identified patent and that said Letters Patent is hereby corrected as shown below:

Column 6, line 30, wherein the number "6" should be --1--.

Signed and Sealed this

*Eighth* Day of *April 1986*

[SEAL]

*Attest:*

DONALD J. QUIGG

*Attesting Officer*

*Commissioner of Patents and Trademarks*